US011118517B2

(12) United States Patent
Tanaka et al.

(10) Patent No.: US 11,118,517 B2
(45) Date of Patent: Sep. 14, 2021

(54) CONSTRUCTION MACHINE

(71) Applicant: YANMAR CO., LTD., Osaka (JP)

(72) Inventors: Katashi Tanaka, Chikugo (JP); Kenji Miyakawa, Chikugo (JP)

(73) Assignee: YANMAR POWER TECHNOLOGY CO., LTD., Osaka (JP)

( * ) Notice: Subject to any disclaimer, the term of this patent is extended or adjusted under 35 U.S.C. 154(b) by 528 days.

(21) Appl. No.: 14/893,699

(22) PCT Filed: Feb. 25, 2014

(86) PCT No.: PCT/JP2014/054453
§ 371 (c)(1),
(2) Date: Nov. 24, 2015

(87) PCT Pub. No.: WO2014/192340
PCT Pub. Date: Dec. 4, 2014

(65) Prior Publication Data

US 2016/0115947 A1 Apr. 28, 2016

(30) Foreign Application Priority Data

May 29, 2013 (JP) ..... JP2013-113331

(51) Int. Cl.
*F02D 29/00* (2006.01)
*F02D 29/04* (2006.01)
(Continued)

(52) U.S. Cl.
CPC ..... *F02D 29/00* (2013.01); *E02F 9/2246* (2013.01); *F02D 29/04* (2013.01); *F02D 41/083* (2013.01);
(Continued)

(58) Field of Classification Search
CPC ..... F04B 17/05; F04B 49/002; F02D 41/083; F02D 29/00; F02D 2200/1004; F02D 2200/703; F02D 29/04; E02F 9/2246
See application file for complete search history.

(56) References Cited

U.S. PATENT DOCUMENTS 5,999,872 A * 12/1999 Kinugawa ..... E02F 9/2025 172/2
7,810,323 B2 * 10/2010 Iwamoto ..... E02F 9/2246 60/431
(Continued)

FOREIGN PATENT DOCUMENTS

EP 0945619 A1 9/1999
EP 2628924 A1 8/2013
(Continued)

OTHER PUBLICATIONS

Raw Machine Translation of JP 2004132195 A, Nishimura, 2004, Torque Control Device for Variable Displacement Type Hydraulic Pump.*
(Continued)

*Primary Examiner* — Charles G Freay
*Assistant Examiner* — Lilya Pekarskaya
(74) *Attorney, Agent, or Firm* — Norton Rose Fulbright US LLP

(57) ABSTRACT

Provided is a construction machine configured so as to prevent wasteful fuel consumption by preventing an engine stall by means of the injection of an appropriate amount of fuel. A backhoe which is a construction machine in which a hydraulic pump is driven by power from an engine is configured so that the output torque characteristics of the engine is set on the basis of the atmospheric pressure detected by an atmospheric pressure sensor which is an atmospheric pressure detection means, and so that a rotational speed is set so that the maximum torque of the engine
(Continued)

at a low idle rotational speed is greater than the maximum absorption torque of the hydraulic pump.

12 Claims, 7 Drawing Sheets

(51) Int. Cl.
*F02D 41/08* (2006.01)
*E02F 9/22* (2006.01)
*F04B 17/05* (2006.01)

(52) U.S. Cl.
CPC ..... *F04B 17/05* (2013.01); *F02D 2200/1004* (2013.01); *F02D 2200/703* (2013.01)

(56) References Cited

U.S. PATENT DOCUMENTS

2005/0071064 A1* 3/2005 Nakamura ..... F02D 29/04 701/50
2009/0101101 A1* 4/2009 Iwamoto ..... E02F 9/2246 123/198 C
2009/0163318 A1 6/2009 Matsuyama
2010/0070146 A1* 3/2010 Ishii ..... E02F 9/2235 701/50
2013/0190994 A1* 7/2013 Narazaki ..... F02D 29/00 701/50

FOREIGN PATENT DOCUMENTS

JP 2000073812 A 3/2000
JP 2004132195 * 4/2004
JP 2004132195 A 4/2004
JP 2006070877 A 3/2006
WO 2012050136 A1 4/2012

OTHER PUBLICATIONS

Korean Intellectual Property Office Notification of Reason for Refusal for corresponding Korean Application No. 10-2015-7035397; dated Jun. 5, 2017.
International Search Report corresponding to Application No. PCT/JP2014/054453; dated Apr. 1, 2014, with English translation.

* cited by examiner

CONSTRUCTION MACHINE

CROSS REFERENCE TO RELATED APPLICATIONS

This is the U.S. national stage of application No. PCT/JP2014/054453, filed on Feb. 25, 2014. Priority under 35 U.S.C. § 119(a) and 35 U.S.C. § 365(b) is claimed from Japanese Application No. 2013-113331, filed May 29, 2013, the disclosure of which is also incorporated herein by reference.

TECHNICAL FIELD

The present invention relates to a construction machine.

BACKGROUND ART

Conventionally, when a construction machine is used in a high ground with low atmospheric pressure, an engine output is reduced following reduction of an air intake amount, whereby an absorbing torque of a hydraulic pump becomes larger than output torque of an engine and frequency of engine failure is increased. Then, the construction machine in which the absorbing torque of the hydraulic pump can be adjusted to an optional value is known. The construction machine has a control device of the hydraulic pump which prevents the engine failure by reducing the absorbing torque of the hydraulic pump following reduction of the engine output. For example, see the Patent Literature 1.

In the construction machine described in the Patent Literature 1, the absorbing torque of the hydraulic pump is controlled so as to reduce load of the engine. Then, when the construction machine is used in the high ground with low atmospheric pressure or a fuel injection amount of the engine is suppressed for corresponding to recent regulation of exhaust gas in the high ground, the output torque of the engine may be reduced more than a reduction amount of the absorbing torque of the hydraulic pump so as to cause the engine failure. There is a problem in that an engine rotational speed is increased more than necessary for preventing the engine failure so as to cause useless consumption of fuel.

PRIOR ART REFERENCE

Patent Literature

Patent Literature 1: the Japanese Patent Laid Open Gazette 2004-132195

DISCLOSURE OF INVENTION

Problems to be Solved by the Invention

The purpose of the present invention is to provide a construction machine which can prevent the engine failure with suitable fuel injection amount so as to suppress useless consumption of fuel.

Means for Solving the Problems

The problems to be solved by the present invention have been described above, and subsequently, the means of solving the problems will be described below.

According to the present invention, in a construction machine in which a hydraulic pump is driven by power from an engine, an output torque characteristic of the engine is set based on an atmospheric pressure detected by an atmospheric pressure detection means, and a low idle rotational speed is set so that a maximum torque of the engine at the low idle rotational speed is larger than a maximum absorbing torque of the hydraulic pump.

According to the present invention, the output torque characteristic is set based on an intake air temperature detected by an intake air temperature detection means and a fuel temperature detected by a fuel temperature detection means.

According to the present invention, whether the low idle rotational speed is set based on the output torque characteristic and the maximum absorbing torque or not can be selected with a switching means.

According to the present invention, when work with a hydraulic actuator is not performed, the low idle rotational speed is not set based on the output torque characteristic and the maximum absorbing torque.

According to the present invention, when an absorbing torque of the hydraulic pump is not more than a predetermined value, the low idle rotational speed is not set based on the output torque characteristic and the maximum absorbing torque.

Effect of the Invention

The present invention brings the following effects.

According to the present invention, the low idle rotational speed is set corresponding to the work state. Accordingly, the engine failure can be prevented with suitable fuel injection amount so as to suppress useless consumption of fuel.

According to the present invention, the low idle rotational speed is set more finely corresponding to the environment. Accordingly, the engine failure can be prevented with suitable fuel injection amount so as to suppress useless consumption of fuel.

According to the present invention, the low idle rotational speed is switched corresponding to request of an operator. Accordingly, useless consumption of fuel can be suppressed without reducing work efficiency.

According to the present invention, the low idle rotational speed is set corresponding to the work state. Accordingly, the engine failure can be prevented with suitable fuel injection amount so as to suppress useless consumption of fuel.

DETAILED DESCRIPTION OF THE INVENTION

Figure 1:
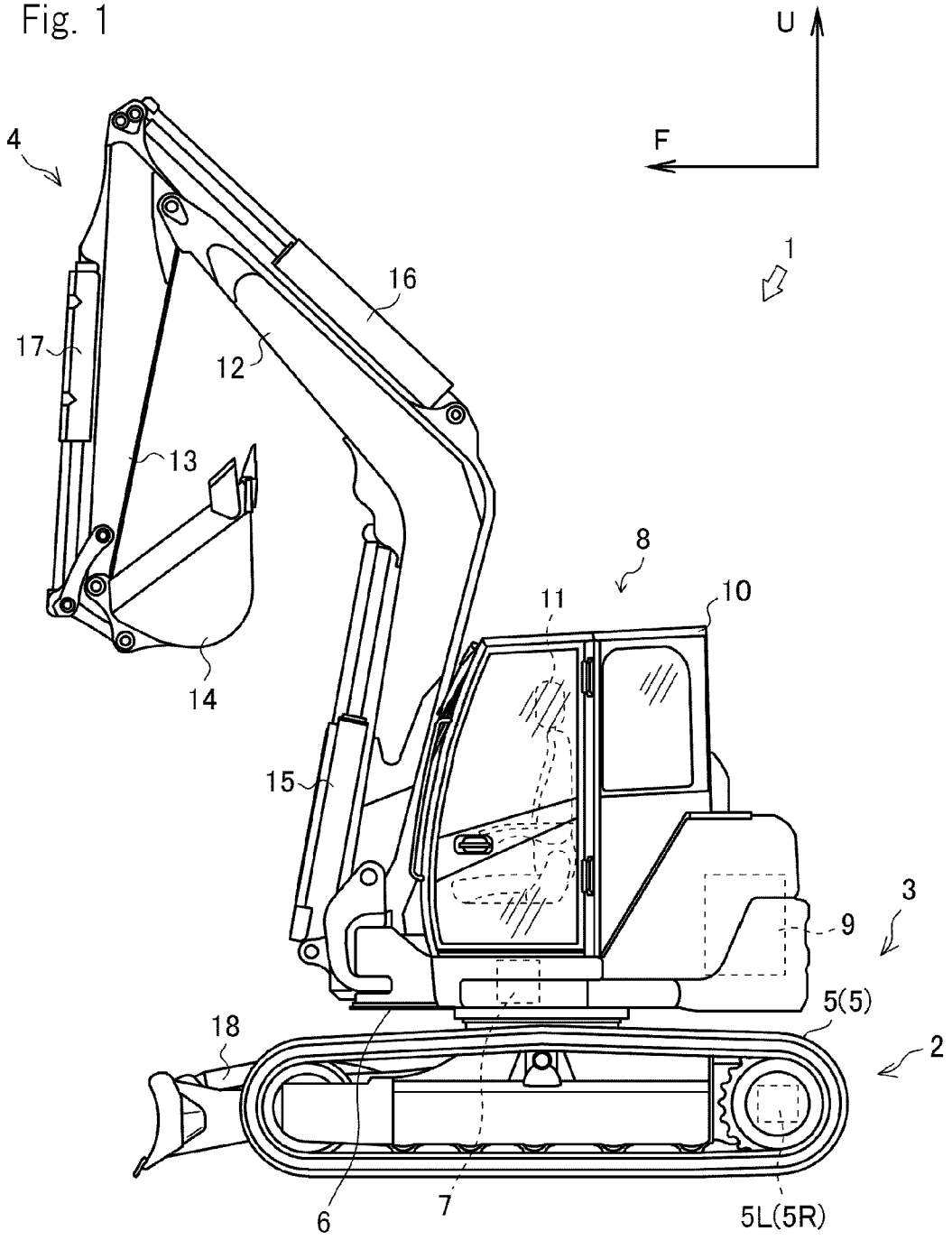
FIG. 1 is a left side view of an entire configuration of a construction machine according to an embodiment of the present invention.

Firstly, a backhoe 1 which is an embodiment of a construction machine according to the present invention is explained referring to FIG. 1. In below explanation, a direction of an arrow A is regarded as a front direction of the backhoe 1 and a direction of an arrow U is regarded as an upward direction of the backhoe 1 so as to specify longitudinal, lateral and vertical directions. Though the backhoe 1 is explained as an embodiment of the construction machine in this embodiment, the construction machine is not limited thereto.

As shown in FIG. 1, the backhoe 1 mainly has a traveling device 2, a revolving device 3 and a working device 4.

The traveling device 2 mainly has a pair of left and right crawlers 5, a left traveling hydraulic motor 5L and a right traveling hydraulic motor 5R. By driving the left crawler 5 by the left traveling hydraulic motor 5L and driving the right crawler 5 by the right traveling hydraulic motor 5R, the traveling device 2 can make the backhoe 1 travel forward and rearward and turn.

The revolving device 3 mainly has a revolving base 6, a revolving motor 7, an operation part 8 and an engine 9. The revolving base 6 is a main structure of the revolving device 3. The revolving base 6 is arranged above the traveling device 2 and supported rotatably by the traveling device 2. In the revolving device 3, by driving the revolving motor 7, the revolving base 6 can be revolved with respect to the traveling device 2. On the revolving base 6, the working device 4, the operation part 8 and the engine 9 which is a power source are arranged.

The operation part 8 has various operation instruments and can operate the backhoe 1. The operation part 8 is provided in a left front part of the revolving base 6. In the operation part 8, a seat 11 is arranged at a substantially center of a cabin 10, and an operation lever device 26 (see FIG. 2) is arranged at left and right sides of the seat 11. The operation lever device 26 can operate the working device 4 and the revolving base 6.

Figure 2:
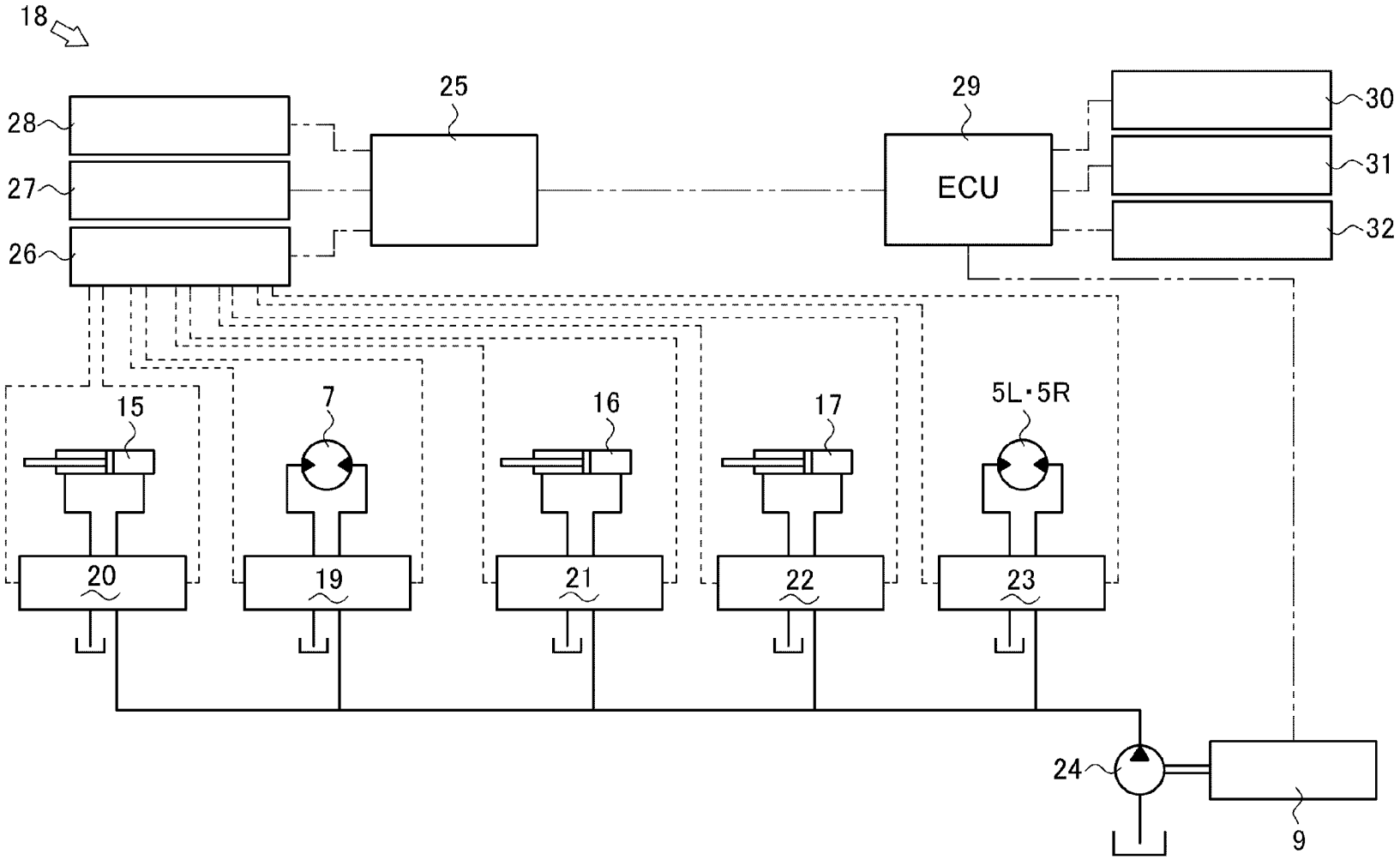
FIG. 2 is a schematic drawing of a hydraulic circuit of the construction machine according to the embodiment of the present invention.

The operation part 8 has an accelerator 27 for changing a throttle opening degree of the engine 9 and a switch 28 which is a switching means (see FIG. 2). By operating the accelerator 27, an operator can change an output of the engine 9 (rotational speed of the engine 9).

The switch 28 selects alternatively whether later-discussed low idle control is confirmed or not, whether automatic deceleration control is confirmed or not, or whether both the low idle control and the automatic deceleration control are confirmed or not. By operating the switch 28, an operator can select whether the low idle control and the automatic deceleration control are confirmed or not respectively.

The working device 4 mainly has a boom 12, an arm 13, a bucket 14 which is a kind of an attachment, a boom cylinder 15, an arm cylinder 16, and an attachment cylinder 17.

One of ends of the boom 12 is supported rotatably on a front part of the revolving base 6. The boom 12 is rotated centering on the one of the ends by the boom cylinder 15 which is driven telescopically.

One of ends of the arm 13 is supported rotatably on the other end of the boom 12. The arm 13 is rotated centering on the one of the ends at by the arm cylinder 16 which is driven telescopically.

One of ends of the bucket 14 which is the kind of the attachment is supported rotatably on the other end of the arm 13. The bucket 14 is rotated centering on the one of the ends by the attachment cylinder 17 which is driven telescopically.

As the above, in the working device 4, an articulated structure which digs soil with the bucket 14 is configured. In the working device 4, hydraulic piping (not shown) is provided for supplying pressure oil to the boom cylinder 15, the arm cylinder 16, and the attachment cylinder 17. Though the working device 4 which has the bucket 14 and performs digging work is provided in the backhoe 1 according to this embodiment, the working device is not limited thereto and a working device 4 which has a hydraulic breaker instead of the bucket 14 and performs crush work may alternatively be provided.

Next, a hydraulic circuit 18 provided in the backhoe 1 is explained referring to FIG. 2.

As shown in FIG. 2, the hydraulic circuit 18 has a revolving motor direction switching valve 19, a boom cylinder direction switching valve 20, an arm cylinder direction switching valve 21, an attachment direction switching valve 22, a traveling motor direction switching valve 23, a hydraulic pump 24, and a control device 25.

The revolving motor direction switching valve 19, the boom cylinder direction switching valve 20, the arm cylinder direction switching valve 21 and the attachment direction switching valve 22 are pilot type direction switching valves which change flows of pressure oil supplied to the revolving motor 7, the boom cylinder 15, the arm cylinder 16, and the attachment cylinder 17 by sliding spools by pilot pressure.

The revolving motor direction switching valve 19 switches direction of pressure oil supplied to the revolving motor 7. When the revolving motor direction switching valve 19 is at one of positions, the revolving motor 7 is driven rotatively along one direction by the pressure oil. When the revolving motor direction switching valve 19 is at the other position, the revolving motor 7 is driven rotatively along the other direction by the pressure oil.

The boom cylinder direction switching valve 20 switches direction of pressure oil supplied to the boom cylinder 15. The boom cylinder 15 is extended and contracted by operation of the boom cylinder direction switching valve 20 so that the boom 10 is swung upward or downward.

The arm cylinder direction switching valve 21 switches direction of pressure oil supplied to the arm cylinder 16. The arm cylinder 16 is extended and contracted by operation of the arm cylinder direction switching valve 21 so that the arm 13 is swung toward a crowd side or a dump side.

The traveling motor direction switching valve 23 switches direction of pressure oil supplied to the left traveling hydraulic motor 5L and the right traveling hydraulic motor 5R (hereinafter, simply referred to as "traveling motors 5L and 5R). When the traveling motor direction switching valve 23 is at one of positions, the traveling motors 5L and 5R are driven rotatively along one direction by the pressure oil. When the traveling motor direction switching valve 23 is at the other position, the traveling motors 5L and 5R are driven rotatively along the other direction by the pressure oil.

The attachment direction switching valve 22 switches direction of pressure oil supplied to the attachment cylinder 17. The attachment cylinder 17 is extended and contracted by operation of the attachment direction switching valve 22 so that the bucket 14 is swung toward a crowd side or a dump side.

The revolving motor direction switching valve 19, the boom cylinder direction switching valve 20, the arm cylinder direction switching valve 21, the attachment direction switching valve 22 and the traveling motor direction switching valve 23 are configured so that directions of flows of pressure oil supplied to the direction switching valves can be changed by pilot pressure based on operation of the operation lever device 26.

The hydraulic pump 24 is driven by the engine 9 and discharges pressure oil. The hydraulic pump 24 is a variable capacity type pump whose discharge amount can be changed by changing a slant angle of a movable swash plate (not shown). The pressure oil discharged from the hydraulic pump 24 is supplied to the direction switching valves.

Next, the control device 25 and an ECU 29 provided in the backhoe 1 are explained.

The control device 25 transmits a control signal to the ECU 29. Substantially, the control device 25 may be configured by connecting a CPU, a ROM, a RAM, a HDD and the like with a bus, or may alternatively be a one-chip LSI or the like. Various programs for controlling the ECU 29 are stored in the control device 25.

The control device 25 is connected to the operation lever device 26 and can obtain an operation signal from the operation lever device 26.

The control device 25 is connected to the accelerator 27 and can obtain an operation signal from the accelerator 27.

The control device 25 is connected to the switch 28 and can obtain an operation signal from the switch 28 (operation signal whether the low idle control and/or the automatic deceleration control are performed or not).

The ECU 29 controls the engine 9 and the like. Substantially, the ECU 29 may be configured by connecting a CPU, a ROM, a RAM, a HDD and the like with a bus, or may alternatively be a one-chip LSI or the like. Various programs for controlling the engine 9 and the like are stored in the ECU 29.

The ECU 29 memorizes an output torque characteristic map M1 for calculating an output torque characteristic Tp (Tp0, Tp1, . . . ) of the engine 9 from an atmospheric pressure P (atmospheric pressures P0, P1, . . . ) so as to satisfy an emission control value, a low idle rotational speed map M2 for calculating a low idle rotational speed Vlb of the engine 9 from the calculated output torque characteristic Tp of the engine 9, and the like.

In this embodiment, the output torque characteristic Tp is an output-permissible range at each engine rotational speed in the state in which the engine 9 satisfies the emission control value (hereinafter, simply referred to as "rotational speed"), that is, a maximum output torque at each rotational speed under the atmospheric pressure P.

In this embodiment, a rotational speed Vla indicates a rotational speed calculated based on the operation of the accelerator 27. The rotational speed Vlb indicates a rotational speed calculated based on the output torque characteristic Tp of the engine 9 so as to make the maximum output torque of the engine 9 at this rotational speed larger than a maximum absorbing torque Th of the hydraulic pump 24. A rotational speed Vlc indicates an original low idle rotational speed of the engine 9.

Figure 3A:
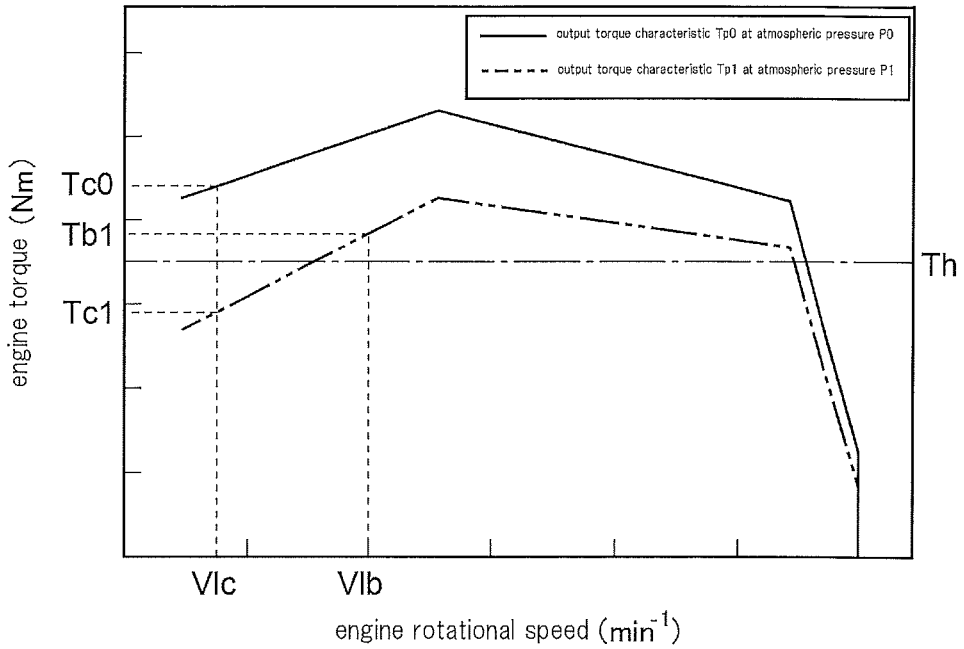
FIG. 3A is a graph of relation between an output torque characteristic of an engine and a low idle rotational speed.

Concretely, an output torque characteristic Tp1 which indicates maximum output torque of the engine 9 at each rotational speed is calculated based on an atmospheric pressure P1 from the output torque characteristic map M1 (see FIG. 3A). The rotational speed Vlb can be calculated based on the calculated output torque characteristic Tp1 from the low idle rotational speed map M2 so as to make a maximum output torque Tb1 at the rotational speed Vlb larger than the maximum absorbing torque Th of the hydraulic pump 24 (see FIG. 3A).

In this embodiment, setting of the calculated rotational speed Vlb as the low idle rotational speed of the engine 9 is regarded as the low idle control. Setting of the rotational speed Vlc as the low idle rotational speed of the engine 9 at the time at which work with a hydraulic apparatus is not performed is regarded as the automatic deceleration control.

The ECU 29 is connected to various sensors and a fuel injection device (not shown) provided in the engine 9 and can control an injection amount of fuel injected by the fuel injection device and the like.

The ECU 29 is connected to an atmospheric pressure sensor 30 and can obtain an atmospheric pressure P detected by the atmospheric pressure sensor 30.

The ECU 29 is connected to a fuel temperature sensor 31 and can obtain a fuel temperature Tf in a fuel injection pump (not shown) detected by the fuel temperature sensor 31.

The ECU 29 is connected to an intake air temperature sensor 32 and can obtain an intake air temperature Ti of the engine 9 detected by the intake air temperature sensor 32.

The ECU 29 can calculate the output torque characteristic Tp of the engine 9 based on the obtained atmospheric pressure P from the output torque characteristic map M1.

The ECU 29 can calculate the rotational speed Vlb based on the calculated output torque characteristic Tp of the engine 9 from the low idle rotational speed map M2.

The ECU 29 is connected to the control device 25 and can obtain operation signals from the operation lever device 26, the accelerator 27 and the switch 28 obtained by the control device 25, an operation signal whether the low idle control is performed or not, and an operation signal whether the automatic deceleration control is performed or not.

Next, referring to FIGS. 3 to 6, a control mode for setting the low idle rotational speed of the engine 9 in the ECU 29 of the backhoe 1 configured as the above is explained. In this embodiment, isochronous control that a fixed engine rotational speed is maintained with respect to variation of load is performed concerning the engine 9 by the ECU 29.

As shown in FIG. 3A, the engine 9 of the backhoe 1 is set by the ECU 29 so that the output torque characteristic is Tp0 when the atmospheric pressure is P0 and the output torque characteristic is Tp1 when the atmospheric pressure is P1. Namely, the engine 9 is controlled so that the output up to a maximum output torque Tc0 is permitted at the rotational speed Vlc which is the low idle rotational speed when the atmospheric pressure is P0 and the output up to a maximum output torque Tc1 is permitted at the rotational speed Vlc which is the low idle rotational speed when the atmospheric pressure is P1. Therefore, in the engine 9, the maximum output torque Tc1 at the rotational speed Vlc is smaller than the maximum absorbing torque Th of the hydraulic pump 24 according to the output torque characteristic.

Figure 3B:
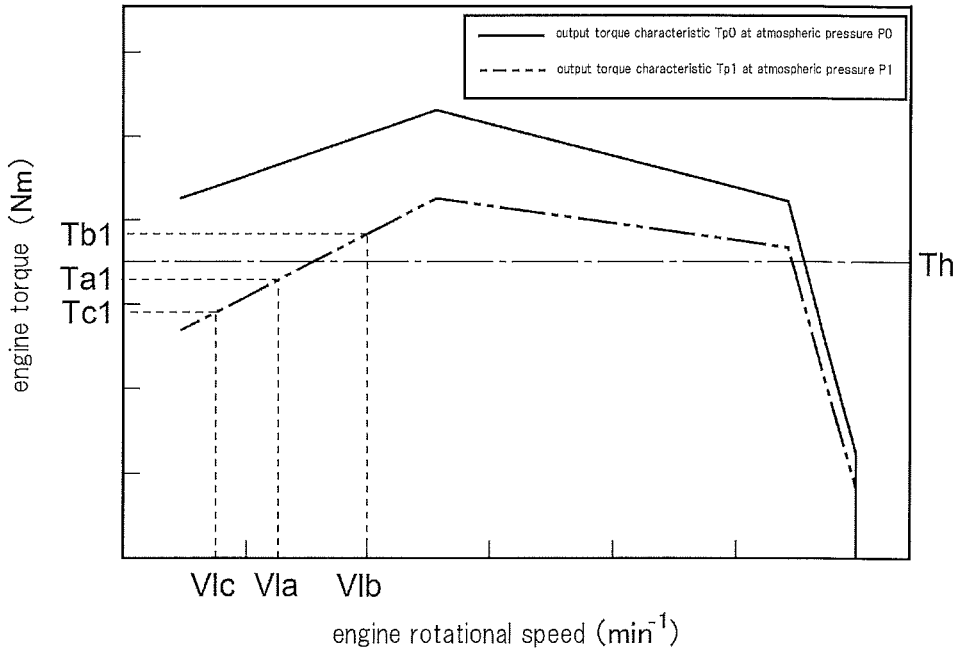
FIG. 3B is a graph of relation between low idle rotational speeds.

As shown in FIG. 3B, the ECU 29 sets the rotational speed of in the engine 9 to be the rotational speed Vla based on an operation amount of the accelerator 27 when the control signal which confirms the low idle control is not obtained from the control device 25. The ECU 29 sets the low idle rotational speed of in the engine 9 to be the rotational speed Vlb when the control signal which confirms the low idle control is obtained from the control device 25. The ECU 29 sets the low idle rotational speed of in the engine 9 to be the low idle rotational speed Vlc until the operation signal of the operation lever device 26 is obtained from the control device 25 when the control signal which confirms the automatic deceleration control is obtained.

A control mode of the ECU 29 for setting the low idle rotational speed of the engine 9 is explained concretely.

Figure 4:
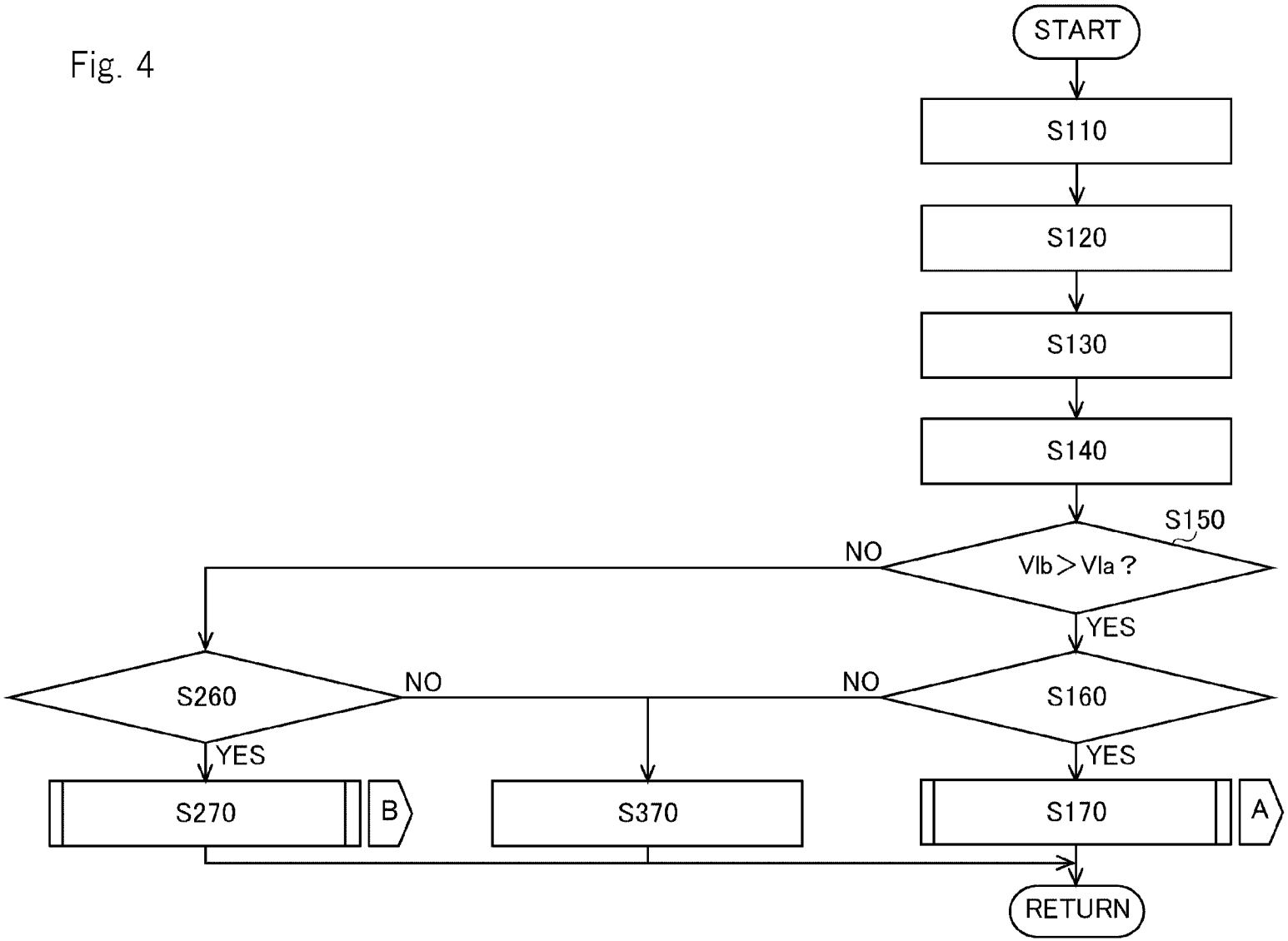
FIG. 4 is a flow chart of a control mode for setting the low idle rotational speed of the construction machine according to the embodiment of the present invention.

As shown in FIG. 4, at a step S110, the ECU 29 obtains the atmospheric pressure P1 detected by the atmospheric pressure sensor 30 and shifts to a step S120. The ECU 29 can obtain the fuel temperature Tf1 in a fuel tank (not shown) detected by the fuel temperature sensor 31 and the intake air temperature Ti1 of the engine 9 detected by the intake air temperature sensor 32.

At the step S120, the ECU 29 obtains the operation signal from the accelerator 27, calculates the rotational speed Vla based on the operation amount of the accelerator 27, and shifts to a step S130.

At the step S130, the ECU 29 calculates the output torque characteristic Tp1 based on the obtained atmospheric pressure P1 from the output torque characteristic map M1, sets the calculated output torque characteristic Tp1 as the output torque characteristic of the engine at the atmospheric pressure P1, and shifts to a step S140. The ECU 29 can calculate the output torque characteristic Tp1 based on the fuel temperature Tf1 and the intake air temperature Ti1 obtained further from the output torque characteristic map M1.

At the step S140, the ECU 29 calculates the rotational speed Vlb based on the set output torque characteristic Tp1 from the low idle rotational speed map M2, and shifts to a step S150.

At the step S150, the ECU 29 judges whether the calculated rotational speed Vlb is larger than the calculated rotational speed Vla or not.

As a result, when the rotational speed Vlb is judged to be larger than the rotational speed Vla, the ECU 29 shifts to a step S160 (see FIG. 3B).

On the other hand, when the rotational speed Vlb is judged not to be larger than the rotational speed Vla, the ECU 29 shifts to a step S260.

At the step S160, the ECU 29 obtains the operation signal of the switch 28 from the control device 25, and judges whether the low idle control is confirmed or not based on the obtained operation signal.

As a result, when the low idle control is judged to be confirmed, the ECU 29 shifts to a step S170.

On the other hand, when the low idle control is judged not to be confirmed, the ECU 29 shifts to a step S370.

Figure 5:
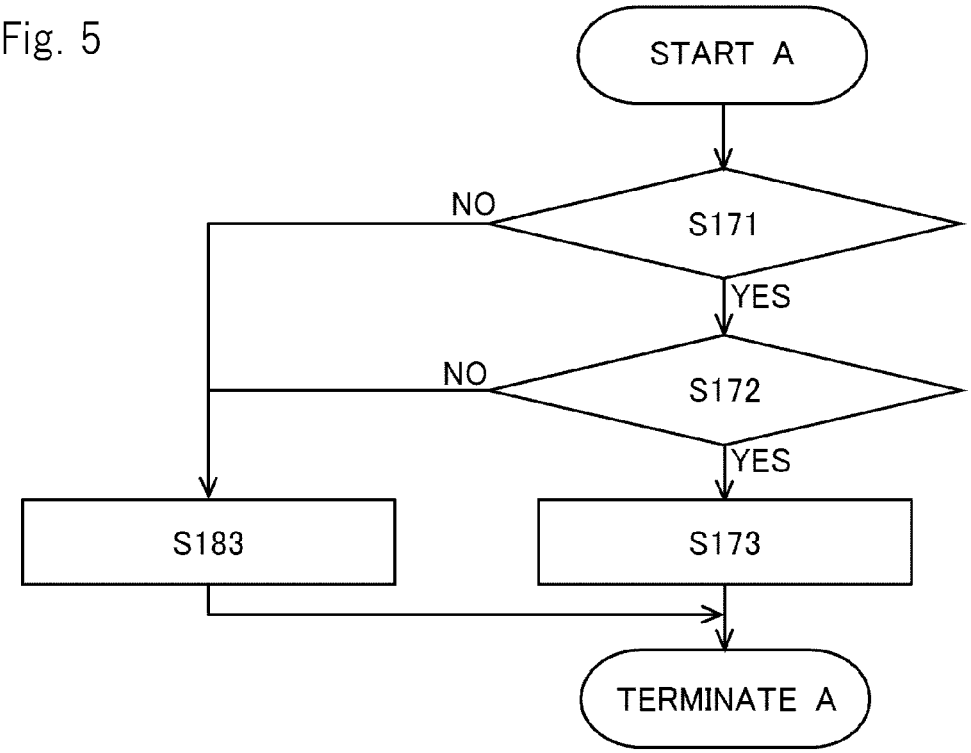
FIG. 5 is a flow chart of a control mode of low idle control of the construction machine according to the embodiment of the present invention.

At the step S170, the ECU 29 starts the low idle control A, and shifts to a step S171 (see FIG. 5). When the low idle control A is finished, the ECU 29 returns to the step S110.

At the step S260, the ECU 29 obtains the operation signal of the switch 28 from the control device 25, and judges whether the automatic deceleration control is confirmed or not based on the obtained operation signal.

As a result, when the automatic deceleration control is judged to be confirmed, the ECU 29 shifts to a step S270.

On the other hand, when the automatic deceleration control is judged not to be confirmed, the ECU 29 shifts to the step S370.

Figure 6:
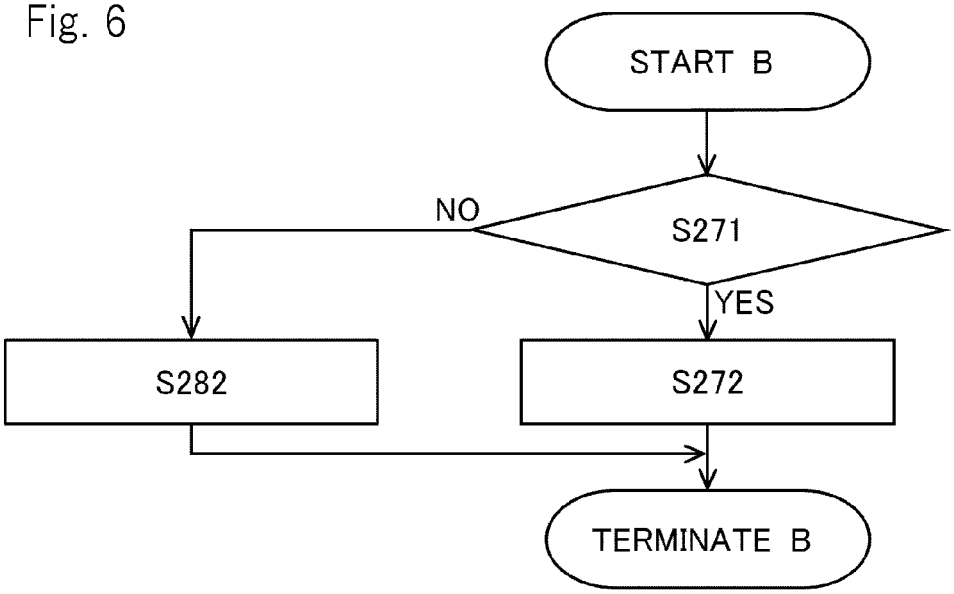
FIG. 6 is a flow chart of a control mode of automatic deceleration control of the construction machine according to the embodiment of the present invention.

At the step S270, the ECU 29 starts the automatic deceleration control B, and shifts to a step 5271 (see FIG. 6). When the automatic deceleration control B is finished, the ECU 29 returns to the step S110.

At the step S370, the ECU 29 sets the low idle rotational speed to be the rotational speed Vlb, and returns to the step S110.

As shown in FIG. 5, at the step S171 of the low idle control A, the ECU 29 obtains the operation signal of the switch 28 from the control device 25, and judges whether the automatic deceleration control is confirmed or not based on the obtained operation signal.

As a result, when the automatic deceleration control is judged to be confirmed, the ECU 29 shifts to a step S172.

On the other hand, when the automatic deceleration control is judged not to be confirmed, the ECU 29 shifts to the step S183.

At the step S172, the ECU 29 judges whether the operation signal of the operation lever device 26 is obtained from the control device 25 or not.

As a result, when the operation signal of the operation lever device 26 is judged not to be obtained, the ECU 29 shifts to a step S173.

On the other hand, when the operation signal of the operation lever device 26 is judged to be obtained, the ECU 29 shifts to the step S183.

At the step S173, the ECU 29 sets the low idle rotational speed to be the rotational speed Vlc, and finishes the low idle control A and returns to the step S110.

At the step S183, the ECU 29 sets the low idle rotational speed to be the rotational speed Vlb, and finishes the low idle control A and returns to the step S110.

As shown in FIG. 6, at the step S271 of the automatic deceleration control B, the ECU 29 judges whether the operation signal of the operation lever device 26 is obtained from the control device 25 or not.

As a result, when the operation signal of the operation lever device 26 is judged not to be obtained, the ECU 29 shifts to a step S272.

On the other hand, when the operation signal of the operation lever device 26 is judged to be obtained, the ECU 29 shifts to the step S282.

At the step S272, the ECU 29 sets the low idle rotational speed to be the rotational speed Vlc, and finishes the automatic deceleration control B and returns to the step S110.

At the step S282, the ECU 29 sets the rotational speed to be the rotational speed Vla, and finishes the automatic deceleration control B and returns to the step S110.

According to the configuration, an operator does not need to set the low idle rotational speed sensuously corresponding to work state. Namely, the backhoe 1 according to the present invention is set to the rotational speed Vla calculated based on the accelerator 27, the rotational speed Vlb calculated based on the output torque characteristic Tp1 of the engine 9, or the rotational speed Vlc which is the original low idle rotational speed of the engine 9 corresponding to the work state and drive state of the engine 9. Furthermore, in the backhoe 1 according to the present invention, an operator determines whether the low idle control and the automatic deceleration control are confirmed or not corresponding to the work state. Accordingly, an engine failure can be prevented with suitable fuel injection amount without reducing work efficiency so as to suppress useless consumption of fuel.

By considering not only the atmospheric pressure P1 detected by the atmospheric pressure sensor 30 but also the fuel temperature Tf1 detected by the fuel temperature sensor 31 and the intake air temperature Ti1 detected by the intake air temperature sensor 32, the low idle rotational speed is set more finely in accordance with environment. Accordingly, the engine failure can be prevented with suitable fuel injection amount so as to suppress useless consumption of fuel.

Figure 7:
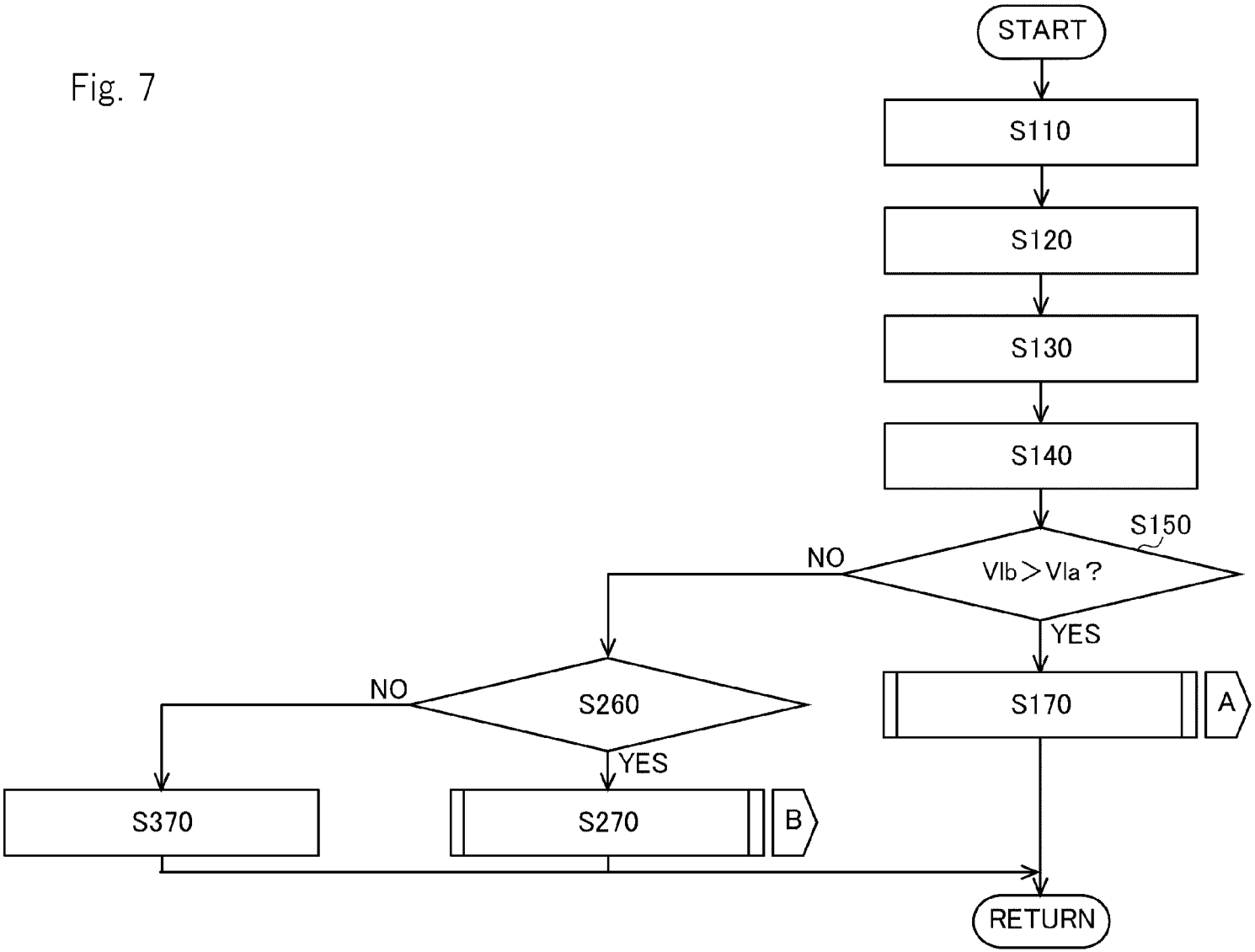
FIG. 7 is a flow chart of a control mode for setting the low idle rotational speed of the construction machine according to another embodiment of the present invention.
Figure 8:
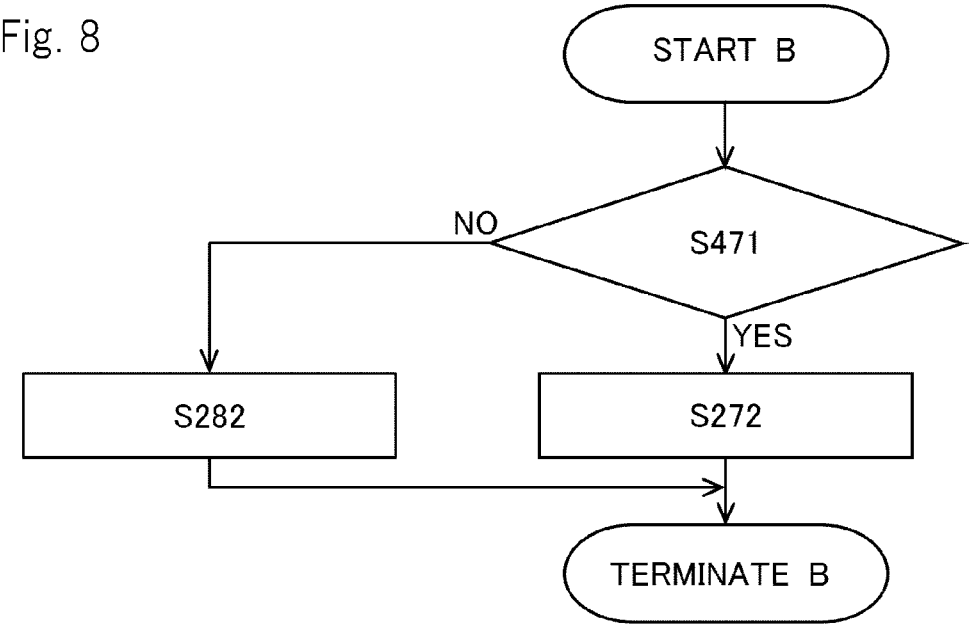
FIG. 8 is a flow chart of a control mode of automatic deceleration control of the construction machine according to another embodiment of the present invention.

Next, the backhoe 1 which is another embodiment of the construction machine according to the present invention is explained referring to FIGS. 7 and 8. In below explanation, a control mode of the ECU 29 for setting the low idle rotational speed of the engine 9 is explained concretely. A concrete explanation of parts similar to the embodiment explained already is omitted, and parts different to the embodiment explained already is explained mainly.

The switch 28 selects alternatively whether the automatic deceleration control is confirmed or not. Namely, the backhoe 1 of this embodiment is configured so that the low idle control is confirmed always. By operating the switch 28, an operator can select whether the automatic deceleration control is confirmed or not.

A control mode of the ECU 29 for setting the low idle rotational speed of the engine 9 is explained concretely.

As shown in FIG. 7, at the step S150, the ECU 29 judges whether the calculated rotational speed Vlb is larger than the calculated rotational speed Vla or not.

As a result, when the rotational speed Vlb is judged to be larger than the rotational speed Vla, the ECU 29 shifts to a step S170 (see FIG. 3B).

On the other hand, when the rotational speed Vlb is judged not to be larger than the rotational speed Vla, the ECU 29 shifts to a step S260.

At the step S170, the ECU 29 starts the low idle control A, and shifts to a step S171 (see FIG. 5). When the low idle control A is finished, the ECU 29 returns to the step S110.

According to the configuration, the backhoe 1 according to the present invention is set to the suitable low idle rotational speed certainly corresponding to the work state and drive state of the engine. Accordingly, the engine failure can be prevented with suitable fuel injection amount so as to suppress useless consumption of fuel.

Furthermore, as shown in FIG. 8, in the automatic deceleration control B, when an absorbing torque of the hydraulic pump 24 is not more than a predetermined value, the rotational speed may be set to Vlc.

Concretely, at a step S471 of the automatic deceleration control B, the ECU 29 judges whether the absorbing torque of the hydraulic pump 24 is not more than the predetermined value or not.

As a result, when the absorbing torque of the hydraulic pump 24 is judged not to be more than the predetermined value, the ECU 29 shifts to the step S272.

On the other hand, when the absorbing torque of the hydraulic pump 24 is judged to be more than the predetermined value, the ECU 29 shifts to a step S282.

According to the configuration, in a work state with low load in which possibility of the engine failure is low, the backhoe 1 according to the present invention is set to the rotational speed Vlc with low fuel consumption. Accordingly, the engine failure can be prevented with suitable fuel injection amount so as to suppress useless consumption of fuel.

INDUSTRIAL APPLICABILITY

The present invention can be used for an art of a construction machine.

DESCRIPTION OF NOTATIONS

1 backhoe
9 engine
24 hydraulic pump
30 atmospheric pressure sensor
P1 atmospheric pressure
Tp1 output torque characteristic
Th maximum absorbing torque
Vlb rotational speed

The invention claimed is:

1. A construction machine comprising:
an engine;
a hydraulic pump operably connected to the engine, the hydraulic pump configured to be driven by a power of the engine;
atmospheric pressure detection means; and
an electronic control unit (ECU);
wherein the ECU is configured to:
set an output torque characteristic of the engine based on an atmospheric pressure detected by the atmospheric pressure detection means; and
set a low idle rotational speed of the engine such that a maximum output torque of the engine at the low idle rotational speed is greater than a maximum absorbing torque of the hydraulic pump.

2. The construction machine according to claim 1, further comprising:
intake air temperature detection means; and
fuel temperature detection means;
wherein the ECU is configured to set the output torque characteristic of the engine based on an intake air temperature detected by the intake air temperature detection means and a fuel temperature detected by the fuel temperature detection means.

3. The construction machine according to claim 1, further comprising:
a switching means; and
wherein the switching means is configured to control whether the low idle rotational speed is set based on the output torque characteristic of the engine and the maximum absorbing torque of the hydraulic pump, such that the maximum output torque of the engine at the low idle rotation speed is greater than the maximum absorbing torque of the hydraulic pump.

4. The construction machine according to claim 2, further comprising:
a switching means; and
wherein the switching means is configured to control whether the low idle rotational speed is set based on the output torque characteristic of the engine and the maximum absorbing torque of the hydraulic pump.

5. The construction machine according to claim 1, wherein the ECU is configured such that, when a work with a hydraulic actuator is not performed, the low idle rotational speed is not set based on the output torque characteristic of the engine and the maximum absorbing torque of the hydraulic pump.

6. The construction machine according to claim 1, wherein the ECU is configured such that, when an absorbing torque of the hydraulic pump is not more than a predetermined value, the low idle rotational speed is not set based on the output torque characteristic of the engine and the maximum absorbing torque of the hydraulic pump.

7. A construction machine comprising:
an engine;
a hydraulic pump operably connected to the engine, the hydraulic pump configured to be driven by a power of the engine;
a pressure sensor; and
an electronic control unit (ECU);

wherein the ECU is configured to control the engine to:

set an output torque characteristic of the engine based on an atmospheric pressure detected by the pressure sensor; and set a low-idle rotational speed of the engine such that a maximum output torque of the engine at the low-idle rotational speed is greater than a maximum absorbing torque of the hydraulic pump.

8. The construction machine according to claim 7, further comprising:

an intake air temperature sensor; and a fuel temperature sensor; and wherein the ECU is configured to set the output torque characteristic of the engine based on an intake air temperature detected by the intake air temperature sensor and a fuel temperature detected by the fuel temperature sensor.

9. The construction machine according to claim 7, wherein the output torque characteristic of the engine is the maximum output torque of the engine at each rotational speed under the atmospheric pressure and the ECU is configured to set the maximum output torque of the engine based on the atmospheric pressure.

10. The construction machine according to claim 9, further comprising:

a switch; and wherein the switch is configured to control whether the low-idle rotational speed is set based on the output torque characteristic of the engine and the maximum absorbing torque of the hydraulic pump.

11. The construction machine according to claim 7, further comprising:

a switch;

a lever;

wherein the ECU is configured to perform a low-idle control to set the low-idle rotational speed of the engine, the low-idle control comprising:

receiving a first signal from the switch and determining whether the first signal corresponds to an on or an off state;

receiving a second signal from the lever and determining whether the second signal corresponds to an on or off state; and based on the first or second signal corresponding to the off state, setting the low-idle rotational speed to a first rotational speed calculated based on an operational output torque characteristic of the engine so as to make the maximum output torque of the engine at the first rotational speed greater than the maximum absorbing torque of the hydraulic pump; and based on the first and second signals being in the on state, setting the low-idle rotational speed to a second rotational speed.

12. The construction machine according to claim 1, wherein the ECU is configured to increase the low idle rotational speed of the engine based on the atmospheric pressure such that the maximum output torque of the engine at the low idle rotational speed is greater than the maximum absorbing torque of the hydraulic pump.

* * * * *